US006886366B2

(12) United States Patent
Oneda

(10) Patent No.: US 6,886,366 B2
(45) Date of Patent: May 3, 2005

(54) ELECTRONIC DEVICE FOR REGULATING AND CONTROLLING THE DELIVERY OF YARN COMING FROM FEED UNITS OF TEXTILE MACHINES

(75) Inventor: Filippo Oneda, Brescia (IT)

(73) Assignee: Orizio Paolo S.p.A., Rodengo Saiano (Brescia) (IT)

( * ) Notice: Subject to any disclaimer, the term of this patent is extended or adjusted under 35 U.S.C. 154(b) by 0 days.

(21) Appl. No.: 10/488,121

(22) PCT Filed: Oct. 3, 2002

(86) PCT No.: PCT/EP02/11137

§ 371 (c)(1),
(2), (4) Date: Feb. 27, 2004

(87) PCT Pub. No.: WO03/031708

PCT Pub. Date: Apr. 17, 2003

(65) Prior Publication Data

US 2004/0237600 A1 Dec. 2, 2004

(30) Foreign Application Priority Data

Oct. 5, 2001 (IT) ..... MI2001A2063

(51) Int. Cl.[7] ..... D04B 15/38
(52) U.S. Cl. ..... 66/125 R
(58) Field of Search ..... 66/125 R, 132 T, 66/132 R, 131, 178 R, 180; 242/365.6, 365.7, 366.4; 2/239, 240, 241, 242

(56) References Cited

U.S. PATENT DOCUMENTS

D67,967 S * 8/1925 Nissen ..... D2/981
D75,805 S * 7/1928 Nebel ..... D2/988
D182,251 S * 3/1958 Rock ..... D2/981
3,858,416 A * 1/1975 White et al. ..... 66/132 R
4,479,078 A * 10/1984 Kidd et al. ..... 318/254
4,686,437 A * 8/1987 Langley et al. ..... 318/254
4,736,601 A 4/1988 Jacobsson
4,764,875 A * 8/1988 Carrotte et al. ..... 66/132 T
5,038,413 A * 8/1991 Ursino ..... 2/239
5,357,660 A * 10/1994 Smith ..... 24/662
5,579,541 A * 12/1996 Christy et al. ..... 2/239
5,912,541 A 6/1999 Bigler et al.
5,983,402 A * 11/1999 Fincher ..... 2/239
6,151,925 A * 11/2000 Earl et al. ..... 66/132 T

FOREIGN PATENT DOCUMENTS

DE 38 27 453 10/1989
GB 2 079 979 1/1982

OTHER PUBLICATIONS

International Search Report.

* cited by examiner

*Primary Examiner*—Danny Worrell
(74) *Attorney, Agent, or Firm*—Hedman & Costigan, P.C.

(57) ABSTRACT

An electronic device for regulating and controlling the delivery of yarn (18) coming from feed units of textile machines, which is designed to vary the r.p.m. of a d.c. brushless motor (23) so as to keep it as synchronized as possible, according to an adjustable scale factor, with the speed of the textile machine served; the device comprises the d.c. brushless motor (23) and an electronic circuit based upon operation of a microcontroller (21) that is able to control the r.p.m. of the motor (23) and the currents (I1, I2, I3) in the phases of the aforesaid motor (23).

7 Claims, 2 Drawing Sheets

ELECTRONIC DEVICE FOR REGULATING AND CONTROLLING THE DELIVERY OF YARN COMING FROM FEED UNITS OF TEXTILE MACHINES

The present invention relates to an electronic device for regulating and controlling the delivery of yarn coming from feed units of textile machines.

Yarn-feed reels of a textile machine are usually set on the top frame of the machine or on a side reel-frame. In this connection, the side reel-frame occupies more space but enables an increase in the number of yarn feeds, the possibility of resorting to double feed at each drop, and the possibility of changing the empty reels more easily and rapidly.

On textile machines with rotating skirts, the reel-frame is fixed to, and set in continuous rotation with, the skirts themselves.

In any case, prior to arriving at the needles, the yarn follows a rather long path to give the machine time to stop before a possible broken end gets caught up.

FIG. 1 shows a typical example of path of the yarn, designated by 18, which reels off the bobbin or reel 10, passes within a first thread-tightener 11 and in an arrest device 12, which operates both in the case of breaking of the thread and in the case of excess tension. The thread-tightener 11 must be located as far as possible from the needles of the textile machine for the reasons mentioned above.

There follows a second thread-tightener 13 used for adjusting the tension to pre-set values, as well as a possible system 14 for controlling feed of the yarn.

Finally, there is envisaged the installation of a machine arrest 15, which acts in the event of breaking of the yarn 18.

In particular, on the most recent circular knitting machines, control of the feed is extremely important. For this reason, positive feeders can be used, which release to the needles a length of yarn that is as constant as possible in time, or accumulation feeders are provided, which maintain the tension of the yarn as constant as possible.

The positive feeder most widely used at the moment is the ribbon feeder (see FIG. 2 attached), whereby a ribbon 16 runs all around the circumference 17, at each drop. The yarn 18 passes between the ribbon 16 and the wheel 19 and acquires the speed of the former so as to obtain a more uniform fabric, regulating the absorption on all the drops with just one operation in so far as, necessarily, all the threads of yarn 18 are fed the individual drops at the same speed.

Alternatively, control of the positive feeders of the yarn can be obtained by means of interchangeable gears located in a special gear-case and by expandable pulleys with manual adjustment.

Adjustment of the expandable pulleys is carried out by slackening a belt, using a belt-tensioner, and then by releasing a ring nut using a pin provided so as to gain access to the plate of the pulley. It is thus possible to adjust the diameter by rotating the aforesaid plate of the pulley, which is provided with reference marks and, finally, to re-tighten the ring nut.

Upon request, further gears are available for different feeds of the yarn and arrangements of the textile machines to accept one-way or multiple-way positive heads, as well as different sizes of the belts.

A purpose of the present invention is therefore to overcome the drawbacks mentioned above and, in particular, to provide an electronic device for regulating and controlling delivery of yarn coming from feed units of textile machines which will enable adjustment of the delivery of yarn by varying the speed of a d.c. motor so as to keep it as synchronized as possible, according to an adjustable scale factor, with the speed of the textile machine served.

Another purpose of the present invention is to provide an electronic device for regulating and controlling delivery of yarn coming from feed units of textile machines which does not involve the use of complex and/or particularly costly technologies and which enables substantial reduction of processing times and of losses in productivity as compared to known techniques by managing the production processes in a more appropriate way.

The above and other purposes are achieved by an electronic device for regulating and controlling delivery of yarn coming from feed units of textile machines according to claim 1, to which the reader is referred for reasons of brevity.

Advantageously, the regulation device according to the invention is made up of a d.c. brushless motor and an electronic circuit, which comprises a microcontroller that is able to control the r.p.m. of the motor and the currents in the phases.

An encoder, connected to the axis of rotation of the motor, enables detection of the r.p.m. and of the incremental position of the motor and comparison of said quantities with the speed of rotation and of the incremental position of the machine, this information being derived from the signals received from the main reference encoder.

The device can be remotely controlled and programmed by means of an asynchronous serial interface of the RS485 half-duplex type, with which it is equipped.

Also provided are two inputs for the connection of sensors for arresting the yarn, of the Hall-effect type, an input available for a manual control for excluding arrest of the yarn, an output of an open-collector type for remote signalling of a condition of collective arrest, and some LEDs for remote display of a state of arrest.

A single 24-V d.c. supply voltage is provided.

Further purposes and advantages of the present invention will emerge clearly from the ensuing description and from the attached schematic drawings, which are provided purely by way of explanatory and non-limiting example of embodiment, in which.

Figure 1:
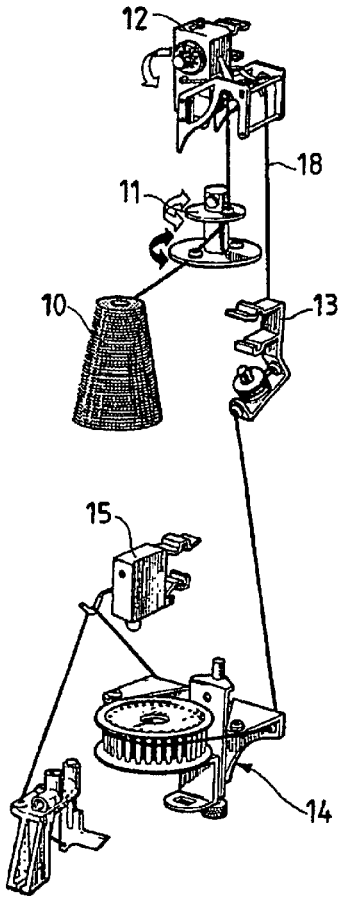
FIG. 1 shows the path of the yarn which is reeling off a reel, in a generic textile machine belonging to the state of the art.
Figure 2:
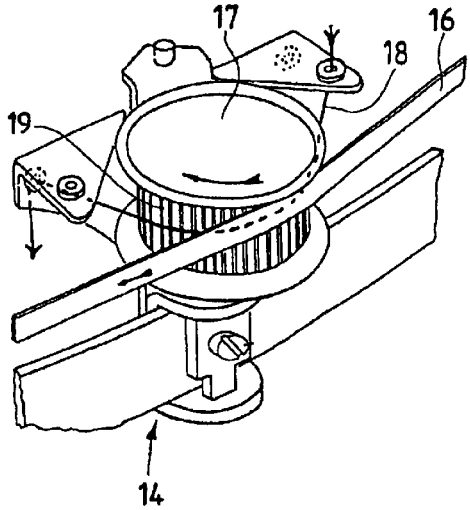
FIG. 2 is a partial perspective view of a ribbon-type positive feeder, which can be used for delivery of yarn in known textile machines.
Figure 3:
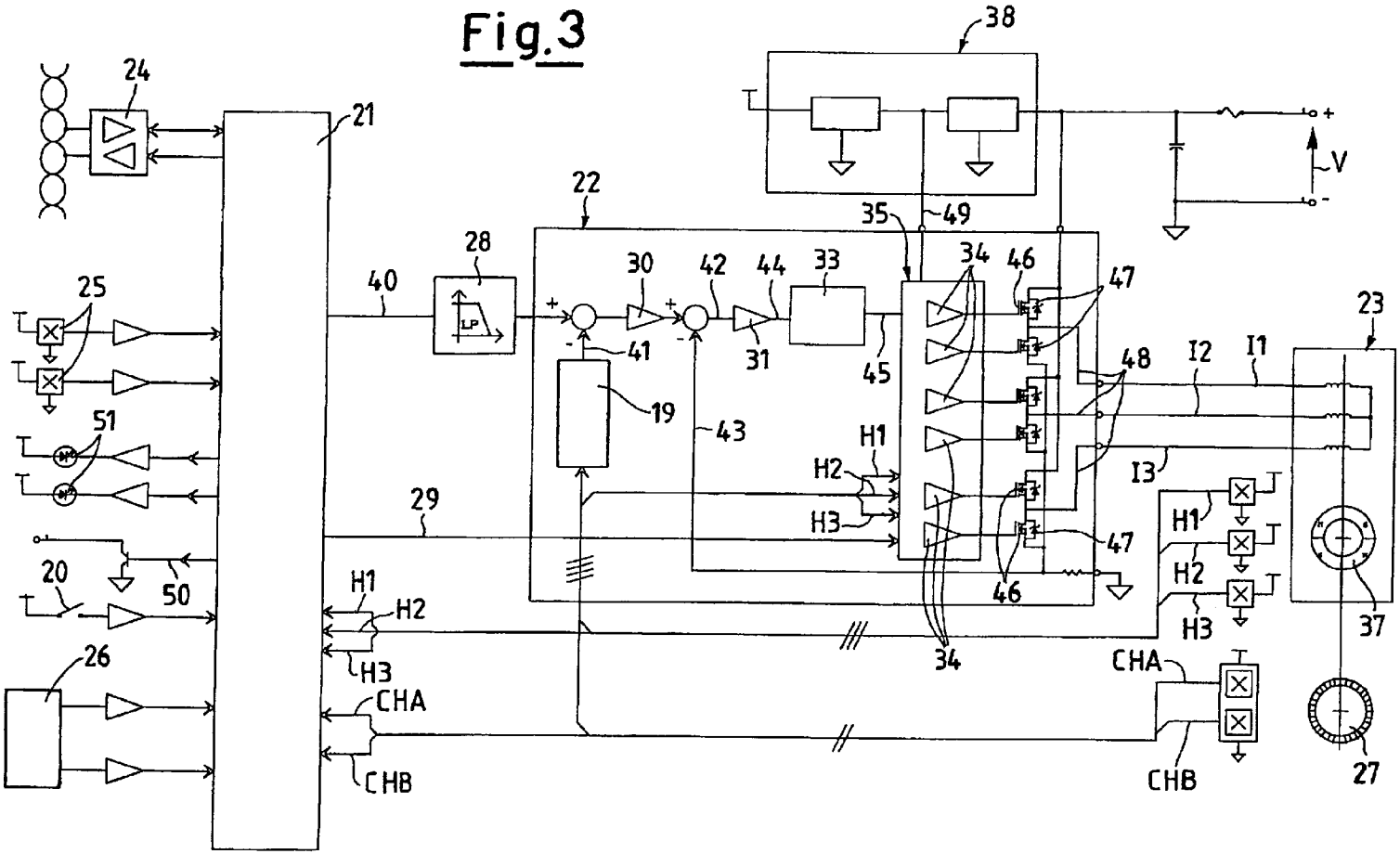
FIG. 3 is a block diagram of an electronic device for regulating delivery of yarn coming from a feed unit of textile machines according to the present invention.

With particular reference to the FIG. 3, the main functional elements of the electronic device for regulating and controlling the delivery of yarn according to the present invention are represented by a microcontroller designated by 21, a signal and power analog section designated by 22, and a d.c. brushless motor 23 associated to a Hall-effect local encoder 27.

The microcontroller 21 receives from a buffer 24 of a serial line of the RS485 type the configuration commands, and transmits, upon command, the information regarding the current situation, driving the signalling outputs accordingly.

The above information is acquired by reading the logic signals coming from a set of sensors 25 for arrest of the yarn or from a manual command 20 for excluding said arrest by reading signals generated by a reference encoder 26 and comparing said signals with the signals coming from the encoder 27 fitted on the shaft of the motor 23.

Also present is an output of an open-collector type designated by 50 which can be used for remote signalling of a condition of collective arrest, and a number of LEDs 51 for remote display of a state of machine arrest.

By taking into account just the advance pulses, the microcontroller 21 calculates the difference between the number of pulses received from the two encoders 26, 27, either incrementing or decrementing the count.

The instantaneous value totalized by the counter, with appropriate corrective factors that can be modified by manual commands issued on the serial line, is used as reference of speed of the analog and power section 22.

The output 40 of the microcontroller 21 is of the PWM type, which can be transformed into a voltage level thanks to the presence of a low-pass filter 28.

In addition, the microcontroller 21 sends further commands, designated as a whole by 29 in FIG. 3, to the analog section 22 for switching of the phases, the said commands being defined according to the dedicated device used for controlling the current in the phases of the d.c. brushless motor 23. In particular, the said commands may consist simply of a dynamic-brake command issued when it is desired to stop the motor 23, or directly of the commands for enabling the three branches of the power bridge, acquired by the microcontroller 21 by decoding the signals H1, H2, H3 for the position of the rotor of the motor 23 with respect to the stator. The analog and power section 22 is made up of a signal portion and a power portion. The signal portion receives the logic signals H1, H2, H3 or CHA, CHB produced by one or more encoders 27 of the motor 23 and, from these, via a frequency/voltage converter 39, derives a unidirectional tachimetric signal 41, of an analog type, which is compared with the speed reference 40 generated by the microcontroller 21 and processed by the low-pass filter 28.

The choice between the logic signals H1, H2, H3 or CHA, CHB depends upon the number of pulses per rev for a uniform movement of the motor 23 at low speed. In fact, exploiting all the signal edges, in the first case (using the signals H1, H2, H3) twelve pulses per rev are obtained, whereas, in the second case (using the signals CHA, CHB), with a 32-pole magnetized wheel, sixty-four pulses are obtained per rev.

The difference (signal 42) between the signals 40 and 41, appropriately filtered by the low-pass filter 30, is used as current reference for the next stage, designated as a whole by 31 in FIG. 3.

Here it is compared with the signal 43 coming from the shunt resistor 32, which is proportional to the current circulating in the phases of the motor 23, generating the control signal 44 for the PWM modulator 33. The output of the latter (designated by 45) fixes the turning-on and turning-off times for the drivers 34 of the MOSFETs 46 of the power bridge 35, whilst the other control signals 29 received from the drivers 34 determine which MOSFETs 46 in each branch of the power bridge 35 must switch and which must remain turned off.

The above control signals 29 may all come from the microcontroller 21 or else may be derived, in part, from the signals H1, H2, H3 for the position of the rotor of the motor 23. This depends upon the dedicated device used for controlling the current in the phases of the d.c. brushless motor 23.

The three-phase power bridge 35 is normally made up of six MOSFETs, designated by 46, and by six freewheeling diodes, designated by 47, and the three branches 48 of the bridge 35 generate the three currents I1, I2, I3 circulating in the three phases of the motor 23 (a maximum current value per phase of approximately 1.5 A is reached).

In addition, since the motor is a d.c. brushless motor, at each instant it is possible to energize the three windings so as to obtain advance of the rotor according to the current position thereof. With the three canonical combinations, in one direction of use of the windings of the motor, which carry out energizing of just two windings at a time, it is possible to exploit a further three intermediate switching combinations, in which, alternately, one winding is connected to the positive side of the supply bus and the other two windings, simultaneously, to the negative side of the supply bus, or vice versa. There are thus obtained six switches for each pole of the motor, to which there correspond six equidistant angular advances of the rotor.

The motor assembly of the entire electronic regulation and control device, in addition to the motor 23 proper (for which the model BLDC48 "Premotec" may be used), comprises an encoder 37 for detecting the position of the rotor of the motor 23, which generates the signals H1, H2, H3, and the local encoder 27, both of which are fitted on the shaft of the motor 23.

The local encoder 27 may be obtained using a magnetized wheel having a diameter that is compatible with the dimensions of the motor 23 and is equipped with thirty-two magnetic poles. For reading, pairs of Hall-effect sensors are preferably used so as to enable discrimination of the direction of revolution, whilst the signals generated may be the classic channels A, B (signal CHB), or else a clock having a frequency proportional to the r.p.m. of the motor 23 (which reaches a maximum of approximately 10 000 r.p.m.) and a bit for the direction of revolution (signal CHA).

The local encoder 27 may then be eliminated if the signals H1, H2, H3 enable a sufficiently regular movement to be obtained at a low r.p.m.

Finally, the electronic device comprises a local power supply 38 of a linear type, which enables a reduced voltage of +5 V for supplying electric power to the logic 22, as well as a possible intermediate voltage for the drivers 34 of the power bridge 35, to be obtained directly from the 24-volt supply voltage V. The power of the bridge and the value of the said intermediate voltage depend upon the characteristics of the dedicated device used for controlling the current in the phases of the brushless motor 23.

Furthermore, an electrolytic capacitor of adequate capacitance provides local coverage of the current peaks absorbed by the motor 23 and initially absorbs the voltage peaks during deceleration, whilst the remaining energy must be absorbed by the 24-V d.c. supply bus 49 and dissipated upstream of the power supply 38.

The characteristics of the electronic device for regulating and controlling the delivery of yarn coming from feed units of textile machines, which forms the subject of the present invention, as well as the advantages, emerge clearly from the foregoing description.

Finally, it is clear that numerous variations may be made to the electronic regulation and control device referred to herein, without thereby departing from the principles of novelty inherent in the inventive idea. It is likewise clear that, in the practical implementation of the invention, the materials, shapes and dimensions of the items illustrated may be any whatsoever according to the requirements, and may be replaced with other technically equivalent ones.

What is claimed is:

1. Electronic device for regulating and controlling the delivery of yarn (18) coming from yarn storage units of textile machines, said electronic device comprising at least one local power supply (38) for supplying electric power and means for varying the r.p.m. of a motor (23) so as to keep it synchronised, according to an adjustable scale factor, with the speed of the textile machine to which said device is connected, wherein said motor (23) is, a D.C. brushless motor and said means for varying the r.p.m. of the motor (23) comprise an electronic circuit, which includes at least one microcontroller (21) that controls the r.p.m. of the motor (23) and the currents (I1, I2, I3) circulating in the phases of said motor (23), characterised in that said D.C. brushless motor has three windings, which can be powered at any time to let the rotor of said motor (23) travel depending on a prefixed position of the rotor, so that, with three combinations of use in one direction of said motor windings, said combinations providing for just two windings to be powered at a time, three further intermediate switching combinations can be utilised, wherein, alternately, one winding is connected to the positive pole of said power supply (38) and the other two windings are simultaneously connected to the negative pole of said power supply (38), or vice versa, to obtain six switchings for each motor pole corresponding to six equidistant angular shifts of said rotor.

2. Electronic device as claimed in claim 1, characterised in that said electronic circuit comprises at least one first encoding element (27), connected to the axis of rotation of said motor (23), enabling detection of the r.p.m. and of the incremental position of the motor (23) and enabling comparison of said motor r.p.m. and said motor incremental position with the rotation speed and the incremental position of the textile machine, said rotation speed and incremental position of the textile machine being derived from signals received from at least one second reference encoding element (26).

3. Electronic device as claimed in claim 1, characterised in that at least one asynchronous serial interface is provided for enabling, by means of a buffer (24), remote control and programming of the electronic device.

4. Electronic device as claimed in claim 2, characterised in that said microcontroller (21) is provided for calculating the difference between the number of pulses received from said first and second encoding elements (26, 27), either incrementing or decrementing the count, so that an instantaneous value, which can be obtained by means of suitable corrective factors that can be modified by manual commands, is used as a speed reference of an analogue and power section (22) of said electronic circuit.

5. Electronic device as claimed in claim 4, characterised in that at least one reference speed signal (40) at the output of said microcontroller (21) can be converted into a voltage level by means of a low-pass filter (28), said microcontroller (21) being also used for sending to said analogue and power section (22) further control signals (29) for switching the phases of said motor (23), said control signals being defined on the basis of a predetermined device used for controlling said currents (I1, I2, I3) circulating in the phases of said motor (23).

6. Electronic device as claimed in claim 5, characterised in that said analogue and power section (22) comprises a signal portion, which receives one set of logic signals (H1, H2, H3; CHA, CHB) produced by said first encoding element (27) of the motor (23), said signal portion deriving from said logic signals (H1, H2, H3; CHA, CHB), via a converting device (39), a unidirectional tachometric signal (41), which is compared with said speed reference signal (40) at the output of said microcontroller (21).

7. Electronic device as claimed in claim 6, characterised in that a signal representing the difference (42) between said speed reference signal (40) and said tachometric signal (41) is filtered and used as current reference signal for a subsequent stage (31) of said analogue and power section (22), wherein said difference signal (42) is compared with a further signal (43), which is proportional to said currents (I1, I2, I3) circulating in the phases of the motor (23), to obtain a control signal (44) for a modulator device (33), the output (45) of which reveals the turning-on and turning-off times for a set of driving means (34, 46) of a power circuit (35), said power circuit (35) using said further control signals (29) for switching the phases of said motor (23), said control signals (29) coming from said microcontroller (21) or being derived, at least partially, from a set of signals (H1, H2, H3) relating to the position of said rotor of the motor (23), said set of signals (H1, H2, H3) being provided by encoding means (37).

* * * * *